US011629932B2

(12) United States Patent
Haag et al.

(10) Patent No.: US 11,629,932 B2
(45) Date of Patent: Apr. 18, 2023

(54) LONG-RANGE OPTICAL DEVICE, IN PARTICULAR TELESCOPIC SIGHT

(71) Applicant: STEINER-OPTIK GMBH, Bayreuth (DE)

(72) Inventors: Peter Haag, Bayreuth (DE); Matthias Ruckdeschel, Bayreuth (DE)

(73) Assignee: STEINER-OPTIK GmbH, Bayreuth (DE)

( * ) Notice: Subject to any disclaimer, the term of this patent is extended or adjusted under 35 U.S.C. 154(b) by 102 days.

(21) Appl. No.: 17/053,750

(22) PCT Filed: Feb. 18, 2019

(86) PCT No.: PCT/EP2019/053992
§ 371 (c)(1),
(2) Date: Nov. 6, 2020

(87) PCT Pub. No.: WO2019/214860
PCT Pub. Date: Nov. 14, 2019

(65) Prior Publication Data

US 2021/0231404 A1 Jul. 29, 2021

(30) Foreign Application Priority Data

May 7, 2018 (EP) ..... 18171035

(51) Int. Cl.
*F41G 1/38* (2006.01)

(52) U.S. Cl.
CPC ..... *F41G 1/38* (2013.01)

(58) Field of Classification Search
CPC ..... F42G 1/16; F42G 1/38; G02B 23/00
(Continued)

(56) References Cited

U.S. PATENT DOCUMENTS 4,777,352 A * 10/1988 Moore ..... G06T 7/60 235/407
4,965,439 A * 10/1990 Moore ..... F41G 3/06 702/158

(Continued)

FOREIGN PATENT DOCUMENTS

DE 202008008630 U1 9/2008
DE 202008008630 U1 * 10/2008 ..... F41G 1/38

(Continued)

*Primary Examiner* — Joshua E Freeman
*Assistant Examiner* — Benjamin S Gomberg
(74) *Attorney, Agent, or Firm* — Rimon Law PC

(57) ABSTRACT

A long-range optical device (1), in particular a telescopic sight, comprising a reticle (6), the position of which is adjustable, and an associated reticle adjustment device (7) for adjusting the position of the reticle (6), a magnetic device (16) comprising a plurality of magnetic elements (16*a*, 16*b*), a detection device (18) associated with the magnetic device (16), wherein the magnetic device (16) is mounted so as to be movable relative to the detection device (18) and/or the detection device (18) is mounted so as to be movable relative to the magnetic device (16), wherein the detection device (18) is configured to detect the relative movements between the magnetic device (16) and the detection device (18) and, based on detected relative movements between the magnetic device (16) and the detection device (18), to generate reticle position information describing the position of the reticle (6).

14 Claims, 2 Drawing Sheets

(58) Field of Classification Search
USPC ..... 42/119, 122
See application file for complete search history.

(56) References Cited

U.S. PATENT DOCUMENTS

| | | | | |
|---|---|---|---|---|
| 6,862,832 | B2 * | 3/2005 | Barrett | F41G 1/38 42/119 |
| 8,336,776 | B2 * | 12/2012 | Horvath | F41G 1/473 235/407 |
| 8,713,843 | B2 * | 5/2014 | Windauer | F41G 1/38 235/404 |
| 9,046,321 | B2 * | 6/2015 | Thomas | G02B 23/02 |
| 9,062,961 | B2 * | 6/2015 | Chen | F41G 1/473 |
| 9,151,570 | B2 * | 10/2015 | Plaster | F41G 1/38 |
| 9,279,975 | B2 * | 3/2016 | Berlips | F41G 1/38 |
| 9,429,745 | B2 * | 8/2016 | Brumfield | G02B 27/36 |
| 10,101,122 | B2 * | 10/2018 | Davidson | F41G 1/38 |
| 10,767,962 | B2 * | 9/2020 | York | F41G 1/44 |
| 10,830,561 | B2 * | 11/2020 | Davidson | G02B 27/32 |
| 11,255,637 | B2 * | 2/2022 | Delz | G01B 7/30 |
| 2003/0025994 | A1 * | 2/2003 | McWilliams | G02B 7/12 359/429 |
| 2015/0247702 | A1 * | 9/2015 | Davidson | F41G 1/473 42/122 |
| 2019/0376764 | A1 * | 12/2019 | Hammond | F41G 1/38 |
| 2021/0207928 | A1 * | 7/2021 | Brewer | F41G 1/14 |
| 2021/0348886 | A1 * | 11/2021 | Havens | F41G 3/165 |
| 2022/0082823 | A1 * | 3/2022 | Grigsby | G02B 27/0068 |
| 2022/0244521 | A1 * | 8/2022 | Liang | G02B 23/16 |
| 2022/0373296 | A1 * | 11/2022 | Cheng | F41G 1/16 |

FOREIGN PATENT DOCUMENTS

| | | | |
|---|---|---|---|
| DE | 202016103781 | A1 | 7/2017 |
| DE | 102016112879 | U1 | 1/2018 |

* cited by examiner

LONG-RANGE OPTICAL DEVICE, IN PARTICULAR TELESCOPIC SIGHT

CROSS-REFERENCE TO RELATED APPLICATIONS

This application is a United States national stage entry of an International Application serial no. PCT/EP2019/053992 filed Feb. 18, 2019, which claims priority to European Patent Application serial no. 18171035.1 filed May 7, 2018. The contents of these applications are incorporated herein by reference in their entirety as if set forth verbatim.

BACKGROUND

The invention relates to a long-range optical device, in particular a telescopic sight, comprising a reticle, the position of which is adjustable, and an associated reticle adjustment device for adjusting the position of the reticle.

Long-range optical devices are essentially known, for example, in the form of telescopic sights mountable or to be mounted on a firearm. Corresponding long-range optical devices comprise multiple optical elements arranged between an objective lens and an ocular lens as essential components, that is, in particular lens elements, which form an optical channel. A reticle, that is, a target marking, is typically provided in the optical channel.

The position of the reticle provided inside the optical channel is adjustable, allowing the reticle to be set to a particular shooting situation, that is, in particular to a given target distance, and an actual target point associated therewith.

A reticle adjustment device, which when actuated by a user causes a corresponding adjustment of the position of the reticle, is associated with the reticle for setting or adjusting the reticle.

The exact detection of the position of the reticle is of particular significance for the marksmanship achievable by way of the long-range optical device. A variety of principles can be derived from the prior art for exactly detecting the position of a reticle. These principles have a complex design at times, and are thus in need of improvement.

It is the object of the invention to provide a long-range optical device that is improved compared to the related prior art, in particular a telescopic sight that is improved compared to the related prior art.

The object is achieved by a long-range optical device according to claim 1. The associated dependent claims relate to possible embodiments of the long-range optical device.

The long-range optical device ("device") described herein is used in particular to optically magnify distant objects viewed through the device. The device can be designed as a telescopic sight, for example, which can be mounted, or is to be mounted, on a gun or firearm. Specifically, the device can thus be a telescopic sight, for example, which can be mounted, or is to be mounted, on a gun or firearm, such as a rifle.

The device comprises multiple optical elements arranged between an objective lens and an ocular lens, that is, in particular optically magnifying elements or element assemblies. The optical elements, which can be lens elements or prisms, for example, form an optical channel.

The device furthermore includes at least one reticle, that is, a target marking. The reticle is arranged in the optical channel of the device formed by the optical elements. The position of the reticle (inside the optical channel) is adjustable, allowing the reticle to be set to a particular shooting situation, that is, in particular to a given target distance, and an actual target point associated therewith. An adjustment of the position of the reticle shall in particular be understood to mean an adjustment of the horizontal and/or vertical position of the reticle, in particular with respect to a horizontal and/or vertical position that is the starting or reference position.

So as to adjust the position of the reticle, the device comprises at least one reticle adjustment device associated with the reticle. A corresponding reticle adjustment device comprises at least one movably mounted part the movement of which is coupled to that of the reticle. The movably mounted part the movement of which is coupled to that of the reticle can form a component of a setting device associated with the reticle adjustment device. A corresponding reticle adjustment device thus typically comprises at least one setting device, which is configured to adjust the position of the reticle in at least one, typically vertical or horizontal, setting direction.

The setting device can be designed as, or at least comprise, a setting mechanism. The setting device or mechanism typically comprises two components that cooperate for adjusting the reticle. A first component of the setting device can be formed by a part the movement of which is coupled to that of the reticle. The part is typically designed as a linearly movably mounted setting element. The setting element can comprise a shaft-like setting section that is movable with respect to the reticle, in particular with a (free) end face. An adjustment of the reticle can thus be carried out by a movement of the setting section with respect to the reticle, which occurs, if necessary, against a restoring force formed by a suitable restoring element, such as a spring. A second component of the setting device can be formed by a rotatably mounted transmission element, which is non-rotatably connected to a rotatably mounted actuating element to be actuated by an operator for adjusting the reticle. The transmission element is coupled to the setting element in such a way that rotational movements of the transmission element can be translated, or are translated, into linear movements of the setting element, in particular with respect to the reticle. The coupling between the transmission element and the setting element can be formed by a mechanical cooperation between transmission element-side thread elements and setting element-side mating thread elements. The transmission element-side thread elements are typically internal thread sections, which are in particular formed in the region of the inner circumference of a hollow-cylindrical transmission element section. The setting element-side mating thread elements are typically external thread sections, which are in particular formed in the region of the outer circumference of a cylindrical setting element section engaging in the hollow-cylindrical transmission element section.

A corresponding setting device is typically formed by a dial, or a component of a dial, of the reticle adjustment device. The device can, of course, comprise multiple corresponding dials. In the process, a first dial can be configured to adjust the vertical position of the reticle, and a second dial can be configured to adjust the horizontal position of the reticle. The principle for detecting or determining the position of the reticle, which is described in more detail hereafter, is typically identical for all dials of the device.

The components of the device, namely a magnetic device and a detection device, will be described in more detail hereafter, which allow the position of the reticle to be exactly detected. As can be derived from the following, the position of the reticle is indirectly detected by detecting the position, or the changes in position, of the actuating element of the reticle adjustment device, the movement of which is coupled to that of the reticle and which is to be actuated by an operator for adjusting the reticle and is mounted so as to rotate about an axis of rotation.

A first component of the device making it possible to detect or determine the position of the reticle is a magnetic device comprising multiple magnetic elements. A respective magnetic element of the magnetic device can have a certain magnetic polarity, that is, for example, a positive or negative magnetic pole, or two opposite magnetic polarities, that is, for example, a positive magnetic pole and a negative magnetic pole. A magnetic element can be a permanently magnetic element (permanent magnet) or an energizable electromagnetic element (electromagnet).

The magnetic elements are typically arranged in a fixed spatial arrangement, which defines the magnetic properties of the magnetic device. The magnetic device thus has certain magnetic properties that, in particular, are defined by the type and arrangement of the magnetic element, that is, in particular a certain detectable magnetic field. As can be derived from the following, the magnetic device can be a magnetic disk comprising multiple annular segment-like or annular segment-shaped magnetic elements, in short, a segmented magnetic disk.

The movement of the magnetic device can be coupled to that of at least one component the movement of which is coupled to that of the reticle, this being, for example, the transmission element of the reticle adjustment device mentioned in connection with the setting device or mechanism. The magnetic device can be movably mounted in this respect. In particular, the magnetic device can be mounted so as to rotate about an axis of rotation, that is, in particular the axis of rotation about which the aforementioned actuating element of the reticle adjustment device is also rotatably mounted.

A second component of the device which makes it possible to detect or determine the position of the reticle is a detection device, implemented as hardware and/or software, which can be associated or is associated with the magnetic device. The movement of the detection device can also be coupled to that of the at least one component of the reticle adjustment device the movement of which is coupled to that of the reticle, this being, for example, the transmission element of the reticle adjustment device mentioned in connection with the setting device or mechanism. The detection device can be movably mounted in this respect. In particular, the detection device can be rotatably mounted about an axis of rotation, that is, in particular the axis of rotation about which the aforementioned actuating element of the reticle adjustment device is also rotatably mounted.

If the detection device or the magnetic device is not movably mounted, it can, for example, be arranged or formed at or in a non-rotatably mounted section of the reticle adjustment device. In particular, the magnetic device or the detection device can be arranged of formed at or in a non-rotatably mounted adapter element of the reticle adjustment device. The adapter element can be configured to attach the reticle adjustment device to a mating adapter element. The attachment is carried out, in particular, by way of a (detachable) screw connection.

It can be derived from the above comments that the magnetic device can be mounted so as to be movable relative to the detection device and/or the detection device can be mounted so as to be movable relative to the magnetic device. The detection device is configured to detect relative movements, these being in particular relative movements between the magnetic device and the detection device, and, based on detected relative movements between the magnetic device and the detection device, to generate reticle position information describing the position of the reticle.

For the preferred embodiment, according to which the magnetic device is movably mounted, that is, in particular rotatably mounted, relative to the positionally fixed detection device,—for this purpose the movement of the magnetic device, as mentioned, can in particular be coupled to that of the transmission element of the setting device of the reticle adjustment device—it applies that the detection device is configured to detect movements of the magnetic device, in particular rotational movements of the magnetic device, relative to the detection device. By way of the detection device, it is thus possible to detect movements of the magnetic device, or of the magnetic elements associated with the magnetic device, relative to the detection device. The detection of movements of the magnetic device relative to the detection device can, for example, take place based on counting the number of magnetic elements moving or moved, within the scope of a corresponding movement of the magnetic device relative to the detection device, along at least one certain detection position of the detection device, which is defined, for example, by a detection element of the detection device. The number of magnetic elements moved with each relative movement of the magnetic device relative to the detection position allows the absolute movement caused by the relative movement, and thus the position of the reticle, to be inferred. The same applies analogously to the embodiment according to which the detection device is movably, that is, in particular rotatably, mounted relative to the magnetic device.

The detection device is furthermore configured, based on detected relative movements between the magnetic device and the detection device, that is, in particular based on detected movements of the magnetic device relative to the detection device, or vice versa, to generate reticle position information describing the position of the reticle. The reticle position information is thus generated based on relative movements between the magnetic device and the detection device, that is, in particular based on movements of the magnetic device relative to the detection device. The reticle position information is typically generated in real time. For this purpose, the detection device can comprise, or communicate with, a suitable processing device.

The generation of the reticle position information typically takes advantage of the fact that the movement of the movably mounted magnetic device, or of the movably mounted detection device, if present, is coupled to that the component of the reticle adjustment device the movement of which is coupled to that of the reticle, according to which movements of the magnetic device, or of the detection device, always correlate from movements of the component the movement of which is coupled to that the reticle, and thus with movements of the reticle. In this way, an exact detection or determination of the position of the reticle is possible.

The magnetic device can comprise a base body, which is plate-like or plate-shaped, for example, and on which the multiple magnetic elements are arranged or formed. Corresponding magnetic elements can be arranged or formed on the upper side and/or lower side of the base body.

As mentioned, the magnetic device can be a magnetic disk comprising multiple annular segment-like or annular segment-shaped magnetic elements, in short, a segmented magnetic disk. The base body can thus have a disk-shaped or annular disk-shaped geometry, wherein the magnetic elements thus having an annular segment-like or annular segment-shaped design are arranged or formed on an upper side and/or a lower side of the disk-shaped or annular disk-shaped base body. In the process, the magnetic elements are typically arranged or designed as individual annular segments, which can be arranged or formed in a ring-like arrangement, or in multiple ring-like arrangements, in particular in at least one radially inner and at least one radially outer ring-like arrangement. A corresponding ring-like arrangement can be designed to be open or closed, wherein magnetic elements arranged or formed directly adjacent to one another in the circumferential direction can be arranged or formed so as to not to make contact with one another (open design) or can be arranged or formed so as to make contact with one another (closed design). The arrangement of magnetic elements in a ring-like arrangement typically occurs with the proviso that each magnetic element of a first polarity is arranged or formed directly adjacent to a magnetic element of a second polarity.

As was mentioned in connection with the at least one detection position of the detection device, the detection device can comprise at least one detection element defining a corresponding detection position. A corresponding detection element can, for example, be designed as or comprise a magnetic sensor element.

The detection device advantageously comprises multiple, that is, at least two, separate detection elements. The detection elements are typically arranged or formed so as to be spatially separated from one another in certain detection positions in one or more planes relative to the magnetic device. The detection elements are typically arranged or formed (directly) above or beneath the magnetic device or the magnetic elements. As can be derived from the following, each detection element is configured, based on a relative movement between the magnetic device and the detection device, that is, in particular a movement of the magnetic device relative to the detection device, that is, in particular the respective detection element, to generate certain information about the position of the reticle.

A first detection element can be configured, based on relative movements between the magnetic device and the detection device, to generate angular position information which can be incorporated, or is incorporated, into the detection of the reticle position information. The angular position information describes the angular position, which is based on a reference value, for example, (in a rotational plane) of a rotatably mounted actuating element, the movement of which is coupled to that of the reticle and which is to be actuated by an operator for adjusting the reticle. Specifically, it is possible, by way of angular position information, for example, to state that, based on a particular rotational plane, the actuating element, after having rotated about the axis of rotation thereof by 45°, for example, in a certain direction of rotation, is located in a position that is rotated, for example, by 45° (based on a reference value or a reference position). The angular position information is typically linked to corresponding clicks of the actuating element caused by the rotational movements of the actuating element.

A second detection element can be configured, based on relative movements between the magnetic device and the detection device, to generate rotational plane position information, which can be incorporated, or is incorporated, into the detection of the reticle position information. The rotational plane position information describes the rotational plane position, which is based on a reference value, for example, of a rotatably mounted actuating element, the movement of which is coupled to that of the reticle and which is to be actuated by an operator for adjusting the reticle. The rotational plane position information thus allows the plane of rotation of the actuating element to be inferred for a given circumferential position of the actuating element. Specifically, it is possible, by way of rotational plane position information, for example, to state that, based on a particular angular position of the actuating element, the actuating element is, for example, located in a first plane of rotation or, after a full rotation thereof, in a second plane of rotation. The rotational plane position information thus describes the number of full revolutions of the actuating element about the axis of rotation thereof. An actual axial movement of the actuating element along the axis of rotation is not absolutely necessary for this purpose.

The option of separately detecting the angular position information and the rotational plane position information by way of separate detection elements provides a robust principle for detecting the position of the reticle. This results in particular from the fact that the angular position information and the rotational plane position information can, in principle, be detected independently of one another. By combining or linking, in terms of data processing, the angular position information and rotational plane position information separately detectable or detected by way of respective detection elements, it is possible to state exactly in which the plane of rotation and, within this very plane of rotation, in which angular position, the actuating element, the movement of which is coupled to that of the reticle, is located. By way of the detection device, it is possible to exactly infer the position of the reticle from the position of the actuating element, due to the given and known coupling of the movement of the actuating element to that of the reticle.

The magnetic device is typically arranged in a fixed, in particular vertical, position relative to the detection device, regardless of adjustments of the reticle. A defined (vertical) distance that cannot be varied by relative movements between the magnetic device and the detection device thus typically exists between the magnetic device and the detection device. In this way, it is possible to increase the accuracy of the detection of the position of the reticle.

The device can comprise an electrical energy supply device, for example in the form of an electrical energy store (battery), for supplying electrical energy-consuming functional elements (electrical consumers) of the device. A control device, which is implemented as hardware and/or software and which is configured to control the provision via the energy supply device to respective electrical consumers of the device, can be associated with the energy supply device. Examples of corresponding electrical consumers of the device are typically also the detection elements of the detection device. The control device can in particular be configured to control the control of the energy supply of one of the detection elements of the detection device, that is, in particular of the second detection element, that is, of the detection element which is configured to generate rotational plane position information that can be incorporated, or is incorporated, into the ascertainment of the reticle position information, in such a way that the detection element is continuously supplied with a certain amount of electrical energy, independently of other electrical consumers of the device, for example in a stand-by mode. In principle, this can also take place via a separate energy supply device of the detection element, that is, a further energy supply device separately associated with the detection element.

The device can comprise an output device, which is configured to acoustically and/or visually and/or haptically output ascertained reticle position information, as well as optionally further information. An output device for outputting acoustic information can comprise a sound output device, an output device for outputting visual information can comprise a display device, for example in the form of an OLED display, and an output device for outputting haptic information can comprise a vibration device. It pertains to an output device for outputting visual information that this is advantageously integrated into the optical channel of the device. When handling the device as intended, that is, when looking through an optical channel, a user can consequently identify not only the actually visually observed or magnified object, but also the output device or the information visually output thereby, that is, for example, image and/or text information.

The device can comprise a one-piece or multi-piece housing part, on or in which all of the aforementioned components of the device can be arranged or formed. At least one connecting device, via which at least one, in particular electronic, external functional component, which can be coupled to the device, can be connected to the device, can be arranged or formed at a corresponding housing part. The device can thus be coupled, in particular on an as-needed basis, to different external functional components, such as a target distance measuring device (range finder). The connecting device can comprise a suitable communication interface, which is configured to transmit (send and/or receive) data between the device and an external functional component, in particular bidirectionally.

Regardless of a corresponding connecting device-side communication interface, the device can furthermore comprise a communication device. The communication device is configured to bidirectionally transmit data, for example of ascertained reticle position information, to at least one external communication partner, in particular wirelessly or in a radio-based manner, if necessary encrypted in terms of the data. For this purpose, the communication device is equipped with, in particular radio-based, bidirectional data transmission protocols suitable for hardware and/or software, which allow Bluetooth or WLAN communication, for example. The communication device can be configured to establish a radio-based Bluetooth or WLAN connection. An external communication partner can be, for example, a further device, a cell phone, a smart phone, a tablet PC, a notebook or a local or global data network, such as an Intranet or the Internet.

The communication device can, of course, also be arranged or formed at or in the housing part of the device. Likewise, however, it is possible for the or a, possibly further, communication device to be arranged or formed in a housing part that is separate from the housing part of the device. In this case, a corresponding connecting device is arranged or formed at the housing part of the device, via which the or a, possibly further, communication device can be connected to the device. The principle of a connecting device described above thus also makes it possible to connect an external communication device to the device as needed.

BRIEF DESCRIPTION OF THE DRAWINGS

The invention is described in more detail based on exemplary embodiments in the drawing figures. In the drawings.

DETAILED DESCRIPTION

Figure 1:
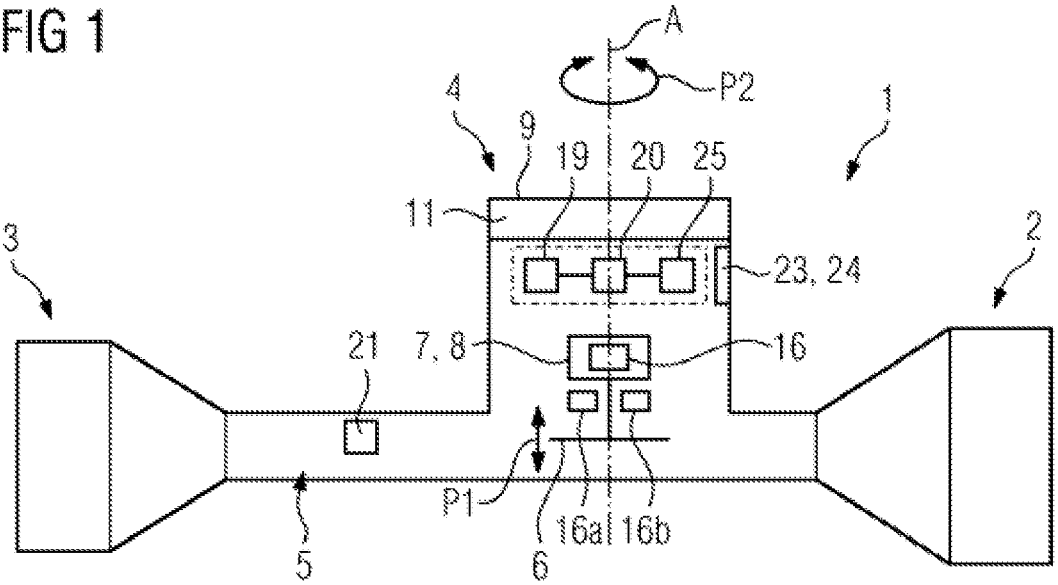
FIG. 1 shows a representative illustration of a long-range optical device according to one exemplary embodiment.

FIG. 1 shows a representative illustration of a long-range optical device 1 ("device") according to one exemplary embodiment. The device 1 is shown in a schematic side view in FIG. 1.

The device 1 is designed as a telescopic sight that can be mounted, or is to be mounted, on a gun or firearm (not shown), that is, a rifle, for example, and that is used to optically magnify distant objects or targets viewed through it. For this purpose, the device 1 comprises multiple optical, that is, in particular optically magnifying, elements (not shown in greater detail) arranged between an objective lens 2 and an ocular lens 3. The optical elements, which are lens elements and/or prisms, for example, form an optical channel 5 that extends through an elongated, one-piece or multi-piece housing part 4 between the objective lens 2 and the ocular lens 3.

The device 1 includes a reticle 6, that is, a target marking. The reticle 6 is provided in the optical channel 5 formed by the optical elements. The position of the reticle 6 (inside the optical channel 5) is adjustable, allowing the reticle to be set to a particular shooting situation, that is, in particular to a particular target distance, and an actual target point associated therewith. An adjustment of the position of the reticle 6 shall typically be understood to mean an adjustment of the horizontal and/or vertical position (see the vertically oriented double arrow P1) of the reticle 6, in particular with respect to a horizontal and/or vertical position that is the starting or reference position.

So as to adjust the position of the reticle 6, the device 1 comprises a reticle adjustment device 7 associated with the reticle 6. The reticle adjustment device 7 comprises at least one setting device 8, which is configured to adjust the position of the reticle 6 in a horizontal or a vertical setting direction. As can be derived from the following, the setting device 8 is designed as a setting mechanism. The setting device 8 typically forms a dial, or a component of a dial.

Figure 2:
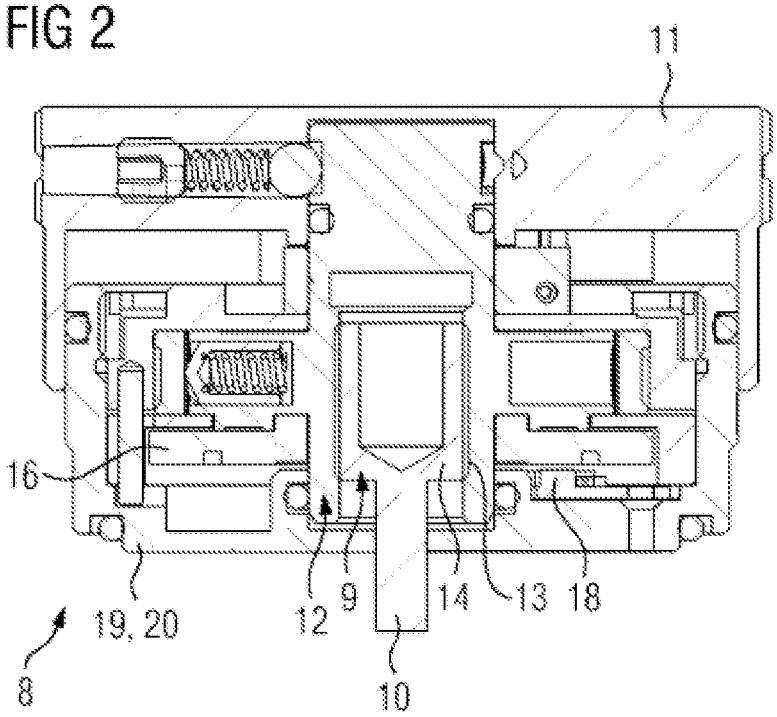
FIGS. 2, 3 each show a representative illustration of a reticle adjustment device of the long-range optical device according to one exemplary embodiment.
Figure 3:
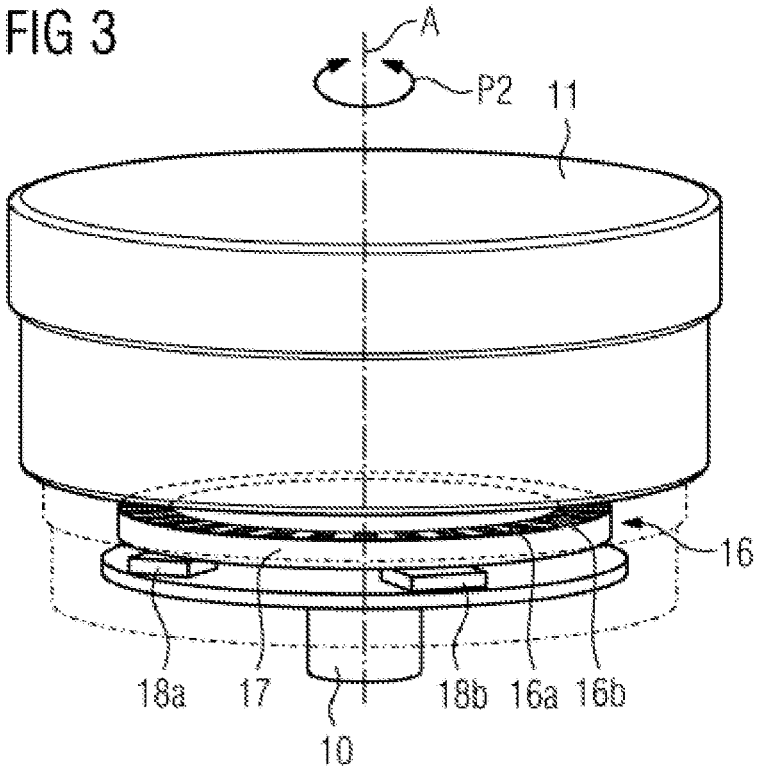

As can be derived based on FIGS. 2, 3, with FIG. 2 showing a cut side view of the reticle adjustment device 7 and FIG. 3 showing a semi-transparently illustrated perspective view of the reticle adjustment device 7, the setting device 8 comprises two components that cooperate for adjusting the reticle 6.

A first component of the setting device 8 is formed by a component, in the form of a linearly movable mounted setting element 9, the movement of which is coupled to that of the reticle 6. The setting element 9 comprises a shaft-like setting section 10 that is movable with respect to the reticle 6 with the (free) end face thereof. An adjustment of the reticle 6 is thus carried out by a movement of the setting section 10 with respect to the reticle 6, which occurs, if necessary, against a restoring force formed by a suitable restoring element (not shown), such as a spring.

A second component of the setting device 8 is formed by a rotatably mounted transmission element 12, which is non-rotatably connected to an actuating element 11 that is to be actuated by an operator, as indicated by the double arrow P2, for adjusting the reticle 6 and mounted so as to rotate about the axis of rotation A. The transmission element 12 is coupled to the setting element 9 in such a way that rotational movements of the transmission element 12 can be translated, or are translated, into linear movements of the setting element 9, in particular with respect to the reticle 6. The coupling between the transmission element 12 and the setting element 9 is formed by a mechanical cooperation between transmission element-side thread elements (not shown) and setting element-side mating thread elements (not shown). The transmission element-side thread elements are internal thread sections, which are formed in the region of the inner circumference of a hollow-cylindrical transmission element section 13. The setting element-side mating thread elements are external thread sections, which are formed in the region of the outer circumference of a cylindrical setting element section 14 engaging in the hollow-cylindrical transmission element section 13.

A first component of the device 1 making it possible to detect or determine the position of the reticle 6 is a magnetic device 16 comprising multiple magnetic elements 16*a*, 16*b*. A respective magnetic element 16*a*, 16*b* of the magnetic device 16 can have a certain magnetic polarity, that is, for example, a positive or negative magnetic pole, or two opposite magnetic polarities, that is, for example, a positive magnetic pole and a negative magnetic pole. A magnetic element 16*a*, 16*b* can be a permanently magnetic element (permanent magnet) or an energizable electromagnetic element (electromagnet).

Figure 4:
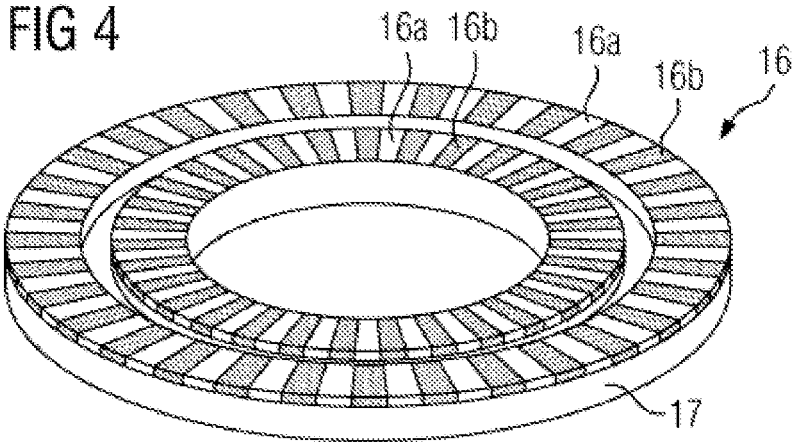
FIG. 4 shows a representative illustration of a magnetic device of the long-range optical device according to one exemplary embodiment.

As can be derived based on FIG. 4, which shows a representative illustration of a magnetic device 16 in a perspective view, the magnetic elements 16*a*, 16*b* are arranged in a fixed spatial arrangement, defining the magnetic properties of the magnetic device 16. The magnetic device 16 thus has certain magnetic properties that, in particular, are defined by the type and arrangement of the magnetic elements 16*a*, 16*b*, that is, in particular a certain detectable magnetic field.

As can be derived based on the exemplary embodiment shown in FIG. 4, the magnetic device 16 can be a magnetic disk comprising multiple annular segment-like or annular segment-shaped magnetic elements 16*a*, 16*b*, in short, a segmented magnetic disk. The magnetic device 16 thus comprises a plate-like or plate-shaped annular disk-like or annular disk-shaped base body 17, on which the multiple magnetic elements 16*a*, 16*b* are arranged or formed. The magnetic elements 16*a*, 16*b* are arranged or formed on an upper side or a lower side of the base body 17. In the process, the magnetic elements 16*a*, 16*b* are typically arranged as individual annular segments, which can be arranged in a ring-like arrangement or, as shown by way of example in FIG. 4, in multiple ring-like arrangements, in particular in at least one radially inner and at least one radially outer ring-like arrangement. The arrangement of the magnetic elements 16*a*, 16*b* in a respective ring-like arrangement obviously occurs with the proviso that each magnetic element 16*a*, 16*b* of a first polarity is arranged directly adjacent to a magnetic element 16*a*, 16*b* of a second polarity.

The movement of the magnetic device 16 is coupled to that of at least one component the movement of which is coupled to that of the reticle 6, that is, of the transmission element 12 of the reticle adjustment device 7 in the exemplary embodiments shown in the figures. The magnetic device 16 is thus rotatably mounted about the axis of rotation A, about which also the aforementioned actuating element 11 of the reticle adjustment device 7 is rotatably mounted.

The detection device 18 is not movably mounted, but is arranged at or in a non-rotatably mounted section 19 of the reticle adjustment device 8. Specifically, the detection device 18 is arranged, by way of example, at or in a non-rotatably mounted adapter element 20 of the reticle adjustment device 7. The adapter element 20 is configured to attach the reticle adjustment device 7 to a mating adapter element (not shown). The attachment is carried out, in particular, by way of a (detachable) screw connection.

In this context, it is be mentioned that the magnetic device 16 is arranged in a fixed vertical position relative to the detection device 18, regardless of adjustments of the reticle 6. A defined vertical distance that cannot be varied by relative movements between the magnetic device 16 and the detection device 18 thus exists between the magnetic device 16 and the detection device 18.

It can be derived from the above comments that the magnetic device 16 is mounted so as to be rotatably movable relative to the detection device 18. The detection device 18 is configured to detect the relative (rotational) movements between the magnetic device 16 and the detection device 18 and, based on detected relative (rotational) movements between the magnetic device 16 and the detection device 18, to generate reticle position information describing the position of the reticle 6. In particular, the detection device 18 is configured to detect rotational movements of the magnetic device 16 relative to the detection device 18. By way of the detection device 18, it is thus possible to detect movements, that is, in particular rotational movements, of the magnetic device 16, or of the magnetic elements 16*a*, 16*b* associated with the magnetic device 16, relative to the detection device 18. The detection of movements, or rotational movements, of the magnetic device 16 relative to the detection device 18 can, for example, take place based on counting the number of magnetic elements 16*a*, 16*b* moving or moved, within the scope of a corresponding rotational movement of the magnetic device 16 relative to the detection device 18, along at least one certain detection position (see FIG. 3) of the detection device 18, which is defined, for example, by a detection element 18*a*, 18*b* of the detection device 18. The number of magnetic elements 16*a*, 16*b* moved with each rotational movement of the magnetic device 16 relative to the detection position allows the absolute movement caused by the relative movement, and thus the position of the reticle 6, to be inferred.

The detection device 18 is configured, based on detected rotational movements of the magnetic device 16 relative to the detection device 18, to generate reticle position information describing the position of the reticle 6. The reticle position information is thus generated based on rotational movements of the magnetic device 16 relative to the detection device 18. The reticle position information is typically generated in real time. For this purpose, the detection device 18 can comprise, or communicate with, a suitable processing device (not shown).

The generation of the reticle position information takes advantage of the fact that the movement of the movably mounted magnetic device 16 is coupled to that of the transmission element 12 of the reticle adjustment device 8, the movement of which is coupled to that of the reticle 6, according to which movements of the magnetic device 16 always correlate from movements of the transmission element 12 the movement of which is coupled to that the reticle 6, and thus with movements of the reticle 6. In this way, an exact detection or determination of the position of the reticle 6 is possible.

As can be derived in particular based on FIG. 3, the detection device 18 comprises two separate detection elements 18*a*, 18*b*. The respective detection elements 18*a*, 18*b* are typically magnetic sensor elements. The detection elements 18*a*, 18*b* are arranged on a carrier element, which is not denoted in more detail, in a plane, spatially separated from one another, in certain detection positions relative to the magnetic device 16 (directly), beneath the magnetic device 16.

A first detection element 18*a* is configured, based on relative movements between the magnetic device 16 and the detection device 18, to generate angular position information which can be incorporated, or is incorporated, into the detection of the reticle position information. The angular position information describes the angular position, which is based on a reference value, for example, (in a rotational plane) of the actuating element 11, the movement of which is coupled to that of the reticle 6 and which is to be actuated by an operator for adjusting the reticle 6. Specifically, it is possible, by way of angular position information, for example, to state that, based on a particular rotational plane, the actuating element 11, after having rotated about the axis of rotation thereof by 45°, for example, in a certain direction of rotation, is located in a position that is rotated, for example, by 45° (based on a reference value or a reference position). The angular position information is typically linked to corresponding clicks of the actuating element 11 caused by the rotational movements of the actuating element 11.

A second detection element 18*b* is configured, based on relative movements between the magnetic device 16 and the detection device 18, to generate rotational plane position information, which can be incorporated, or is incorporated, into the detection of the reticle position information. The rotational plane position information describes the rotational plane position, which is based on a reference value, for example, of an actuating element 11, the movement of which is coupled to that of the reticle 6 and which is to be actuated by an operator for adjusting the reticle 6. The rotational plane position information thus allows the plane of rotation of the actuating element 11 to be inferred for a given circumferential position of the actuating element 11. Specifically, it is possible, by way of rotational plane position information, for example, to state that, based on a particular angular position of the actuating element 11, the actuating element 11 is, for example, located in a first plane of rotation or, after a full rotation thereof, in a second plane of rotation. The rotational plane position information thus describes the number of full revolutions of the actuating element 11 about the axis of rotation A thereof. An actual axial movement of the actuating element 11 along the axis of rotation A is not necessary for this purpose.

The option of separately detecting the angular position information and the rotational plane position information by way of separate detection elements 18*a*, 18*b* provides a robust principle for detecting the position of the reticle 6. This results in particular from the fact that the angular position information and the rotational plane position information can, in principle, be detected independently of one another. By combining or linking, in terms of data processing, the angular position information and rotational plane position information separately detectable or detected by way of the detection elements 18*a*, 18*b*, it is possible to state exactly in which plane of rotation and, within this very plane of rotation, in which angular position the actuating element 11, the movement of which is coupled to that of the reticle 6, is located. By way of the detection device 18, it is possible to exactly infer the position of the reticle 6 from the position of the actuating element 11, due to the given and known coupling of the movement of the actuating element 11 to that of the reticle 6.

As can be derived based on FIG. 1, the device can 1 comprise an electrical energy supply device 19, for example in the form of an electrical energy store (battery), for supplying electrical energy-consuming functional elements (electrical consumers) of the device 1. A, possibly central, control device 20 of the device 1, which is implemented as hardware and/or software and which is configured to control the provision via the energy supply device 19 to respective electrical consumers of the device 1, is associated with the energy supply device 19. Examples of corresponding electrical consumers of the device 1 are also the detection elements 18*a*, 18*b* of the detection device 18. The control device 20 is configured to control the control of the energy supply of one of the detection elements 18*a*, 18*b*, that is, in particular of the second detection element 18*b*, which is configured to generate rotational plane position information that can be incorporated, or is incorporated, into the ascertainment of the reticle position information, in such a way that the detection element is continuously supplied with a certain amount of electrical energy, independently of other electrical consumers of the device 1, for example in a stand-by mode. In principle, this can also take place by way of a separate energy supply device (not shown) of the detection element 18*b*.

As can likewise be derived based on FIG. 1, the device 1 can comprise an output device 21, which is configured to acoustically and/or visually and/or haptically output ascertained reticle position information, as well as optionally further information. The output device 21 can, for example, comprise a display device, for example in the form of an OLED display, which is integrated into the optical channel 5 of the device 1. When handling the device 1 as intended, that is, when looking through the optical channel 5, a user can consequently identify not only the actually visually observed or magnified object, but also the output device 21 or the information visually output thereby, that is, for example, image and/or text information.

It can be derived based on FIG. 1 that the aforementioned components of the device 1 can be arranged or formed at or in the housing part 4 of the device 1. The housing part 4 also comprises the dial comprising the reticle adjustment device 7. At least one connecting device 23, via which at least one, in particular electronic, external functional component, which can be coupled to the device 1, can be connected to the device 1, can be arranged or formed at the housing part 4. The device 1 can thus be coupled, in particular on an as-needed basis, to different external functional components, such as a target distance measuring device (range finder). The connecting device 23 can comprise a suitable communication interface 24, which is configured to transmit (send and/or receive) data between the device 1 and an external functional component, in particular bidirectionally.

Regardless of a corresponding connecting device-side communication interface 24, the device 1 can furthermore comprise a communication device 25. The communication device 25 is configured to bidirectionally transmit data, for example of ascertained reticle position information, to at least one external communication partner, in particular wirelessly or in a radio-based manner, if necessary encrypted in terms of the data. For this purpose, the communication device 25 is equipped with, in particular radio-based, bidirectional data transmission protocols suitable for hardware and/or software, which allow Bluetooth or WLAN communication, for example. The communication device 25 can be configured to establish a radio-based Bluetooth or WLAN connection. An external communication partner can be, for example, a further device, a cell phone, a smart phone, a tablet PC, a notebook or a local or global data network, such as an Intranet or the Internet.

As is shown by way of example in FIG. 1, the communication device 25 can also be arranged at or in the housing part 4 of the device 1. Likewise, however, it is possible for the or a, possibly further, communication device 25 to be arranged in a housing part (not shown) that is separate from the housing part 4 of the device 1. In this case, a corresponding connecting device (not shown) is arranged at the housing part 4 of the device 1, via which the or a, possibly further, communication device can be connected to the device 1. The principle of a connecting device 23 described above thus also makes it possible to connect an external communication device to the device 1 as needed.

Even though this is not shown in the exemplary embodiments shown in the figures, a reverse configuration is also conceivable, in principle, according to which the detection device 18 is movably mounted in a corresponding manner, and the magnetic device 16 is not movably mounted.

The invention claimed is:

1. A long-range optical device, comprising:

a reticle, the position of which is adjustable, and an associated reticle adjustment device for adjusting the position of the reticle, a magnetic device comprising multiple magnetic elements, wherein the magnetic device comprises a base body, wherein the magnetic elements are arranged or formed on an upper side and/or a lower side of the base body, and a detection device associated with the magnetic device, wherein the magnetic device is mounted so as to be movable relative to the detection device and/or the detection device is mounted so as to be movable relative to the magnetic device, the detection device being configured to detect relative movements between the magnetic device and the detection device and, based on the detected relative movements between the magnetic device and the detection device, to generate reticle position information describing the position of the reticle; wherein the detection device comprises at least two separate detection elements; wherein at least one of the at least two separate detection elements is configured, based on the detected relative movements between the magnetic device and the detection device, to generate angular position information, which is incorporated into the reticle position information and which describes an angular position of a rotatably mounted actuating element, the movement of which is coupled to that of the reticle and which is to be actuated by an operator for adjusting the reticle; and wherein at least one of the at least two separate detection elements is configured, based on the detected relative movements between the magnetic device and the detection device, to generate rotational plane position information, which is incorporated into the reticle position information and which describes a rotational plane position of the rotatably mounted actuating element, the movement of which is coupled to that of the reticle and which is to be actuated by the operator for adjusting the reticle.

2. The long-range optical device according to claim 1, wherein the magnetic device is a movably mounted magnetic device, wherein a movement of the magnetic device is coupled to that of at least one component of the reticle adjustment device, the movement of which is coupled to that of the reticle.

3. The long-range optical device of claim 2, wherein the magnetic device is rotatably mounted.

4. The long-range optical device according to claim 1, wherein the base body has a disk-shaped or annular disk-shaped geometry.

5. The long-range optical device according to claim 4, wherein the magnetic elements are arranged or formed as individual annular segments in at least one ring-shaped arrangement.

6. The long-range optical device according to claim 5, wherein the magnetic elements are arranged or formed in a plurality of the ring-shaped arrangements.

7. The long-range optical device according to claim 6, wherein the plurality of the ring-shaped arrangements, in which the magnetic elements are arranged or formed, includes at least one radially inner ring-shaped arrangement and at least one radially outer ring-shaped arrangement.

8. The long-range optical device according to claim 1, wherein the magnetic elements are arranged or formed adjacent to one another, wherein a first plurality of the magnetic elements have a first polarity and a second plurality of the magnetic elements have a second polarity, wherein a magnetic element of the first plurality of magnetic elements is arranged or formed directly adjacent to a magnetic element of the second plurality of the magnetic elements.

9. The long-range optical device according to claim 1, further comprising an electric energy supply device which is configured to supply electrical energy to at least one electrical energy-consuming functional element, and a control device associated with the electrical energy supply device and configured to control the electrical energy supplied to the at least one electrical energy-consuming functional element from the electrical energy supply device.

10. The long-range optical device according to claim 9, wherein the control device is configured to control the energy supply device such that electrical energy is continuously supplied, independently of the at least one electrical energy-consuming functional element, from the electrical energy supply device to the at least one detection element configured to generate the rotational plane position information.

11. The long-range optical device according to claim 1, wherein the magnetic device is arranged in a fixed position relative to the detection device, regardless of adjustments of the reticle.

12. The long-range optical device according to claim 11, wherein the magnetic device is arranged in a fixed vertical position relative to the detection device, regardless of the adjustments of the reticle.

13. The long-range optical device according to claim 1, further comprising a communication device, which is configured to bidirectionally transmit data externally.

14. The long-range optical device according to claim 13, wherein the data comprises the reticle position information.

* * * * *